US010094368B2

(12) United States Patent
Mao et al.

(10) Patent No.: US 10,094,368 B2
(45) Date of Patent: Oct. 9, 2018

(54) TOWER DRIVE PUMPING UNIT

(71) Applicant: International Business Alliance Management, Inc., Sherman Oaks, CA (US)

(72) Inventors: Hongwei Mao, Beijing (CN); Dah Kong Chen, Sherman Oaks, CA (US)

(73) Assignee: International Business Alliance Management, Inc., Sherman Oaks, CA (US)

( * ) Notice: Subject to any disclaimer, the term of this patent is extended or adjusted under 35 U.S.C. 154(b) by 218 days.

(21) Appl. No.: 14/997,262

(22) Filed: Jan. 15, 2016

(65) Prior Publication Data

US 2016/0160581 A1 Jun. 9, 2016

Related U.S. Application Data

(63) Continuation-in-part of application No. 13/810,166, filed as application No. PCT/CN2011/077098 on Jul. 13, 2011, now abandoned.

(51) Int. Cl.

| | |
|---|---|
| ***F04B 47/02*** | (2006.01) |
| ***B66F 17/00*** | (2006.01) |
| ***E21B 43/12*** | (2006.01) |

(52) U.S. Cl.

CPC ..... *F04B 47/022* (2013.01); *B66F 17/00* (2013.01); *E21B 43/126* (2013.01)

(58) Field of Classification Search

CPC .... E21B 43/125; E21B 43/126; E21B 43/127; E21B 15/003; E21B 2043/125; E21B 19/00; E04G 3/28; E04G 2001/242; E04G 2003/283; F04B 47/02; F04B 47/022; F04B 47/028; F04B 53/22; B25B 1/00; B25B 5/00; B25B 5/003

USPC ..... 166/68, 105; 188/157, 158, 162; 182/36, 182/39, 63.1; 269/43, 309, 310; 417/359, 360; 248/656

See application file for complete search history.

(56) References Cited

U.S. PATENT DOCUMENTS

| | | | |
|---|---|---|---|
| 1,381,583 | A | 6/1921 | Mull |
| 2,508,679 | A | 5/1950 | McClellan et al. |
| 3,640,342 | A | 2/1972 | Gault |

(Continued)

FOREIGN PATENT DOCUMENTS

CN 101775969 * 7/2010 ..... F04B 9/02

*Primary Examiner* — Kenneth J Hansen
(74) *Attorney, Agent, or Firm* — Kelly & Kelley, LLP

(57) ABSTRACT

A numerical controlled drive tower pumping unit includes a main tower frame, a power system, a drive system, a control system, a wire rope wheel, a balance weight box, and a suction rod. The power system, drive system, and control system work to alternately raise and lower the suction rod. The pumping unit includes a safety braking system configured to permit free rotation of the drive system in a normal operating state and prevent rotation of the drive system in an abnormal operation state. The pumping unit includes a tower moving mechanism configured to roll the main tower frame along a foundation frame from a normal operation position with the main tower frame proximate to a wellhead borehole to a workover position with the main tower frame distant from the wellhead borehole. The moving mechanism includes retractable roller assemblies to facilitate movement of the main tower frame.

21 Claims, 11 Drawing Sheets

(56) References Cited

U.S. PATENT DOCUMENTS

| | | | | |
|---|---|---|---|---|
| 4,023,655 | A * | 5/1977 | Anzai | B66D 5/08 188/162 |
| 6,155,178 | A | 12/2000 | Pease | |
| 2004/0172883 | A1 | 9/2004 | Rogers et al. | |
| 2008/0128124 | A1* | 6/2008 | Jin | E21B 19/02 166/105 |
| 2011/0036662 | A1* | 2/2011 | Smith | E04G 1/36 182/37 |
| 2013/0058803 | A1 | 3/2013 | Mao | |

* cited by examiner

TOWER DRIVE PUMPING UNIT

RELATED APPLICATIONS

This is a continuation-in-part application of U.S. patent application Ser. No. 13/810,166, filed Jan. 14, 2013, which is a U.S. National Stage application under 35 U.S.C § 371 of International Application No. PCT/CN2011/077098, filed Jul. 13, 2011.

FIELD OF THE INVENTION

The present invention is generally directed to a mechanical device or apparatus for the extraction of oil from a well. More particularly, the present invention is directed to a numerically controlled tower-type oil pumping unit having a combination drive with a safety brake system to provide for safer operation. The invention also includes a tower moving system to address problems in similar units with well workover.

BACKGROUND OF THE INVENTION

Currently, in oil extracting fields, beam pumping units are gradually being replaced by tower-type oil pumping units resulting from their benefits of a simpler structure, simpler operation and maintenance, low unit cost, and low energy consumption. A Chinese application for a utility patent—Application No. 2008102388641.1—has been published in China on a combination drive tower pumping unit. The drive system of the unit employs belts, chains, or combinations of belts and chains in combination with a permanent magnet synchronized braking motor of low-speed and large-torque. The drive system transfers mechanical power to a first transfer shaft in a first stage speed reduction and to a second transfer shaft in a second stage speed reduction via a pair of gears. This transfer causes the drive wire rope and balance weight pull rope, both of which are wrap fastened to the wire rope wheel, to move sucker rods and a balance weight box in an up and down motion to accomplish oil pumping tasks. Using a chain or a belt and chain combination to achieve the first stage speed reduction has the benefits of reducing mechanical power loss, maintaining higher operating efficiency under large load, and reducing noise level in environment sensitive area. The drawback of such tower pumping units is added effort and low work efficiency during oil well workover, such workover requiring that the wire rope wheel, weighing several tons as a large diameter wheel, be moved away from its working position.

Accordingly, there is a need for a tower pumping unit that provides a moving system to allow for well workover in an easier and more efficient manner. The present invention fulfills these needs and provides other related advantages.

SUMMARY OF THE INVENTION

The present invention is directed to a numerically controlled tower pumping unit with a combination drive, a safety brake system to ensure safe operation, and a tower moving system to solve the well workover problem inherent in such units.

The numerically controlled tower type combination drive pumping unit of the present invention generally has a main tower frame supporting a raised operating platform. The operating platform has a power system, a drive system, and a control system mounted thereon. The power system is electrically connected to the drive system to power the same with the control system operationally connected to the drive system. The drive system is configured to operate a wire rope wheel that alternately raises and lowers a suction rod and a balanced weight box.

In one embodiment, the pumping unit may also include a safety brake system that is operationally connected to the drive system. The safety brake system has a brake cylinder fixedly disposed around a rotating shaft of the drive system. A pair of braking elements surrounding the brake cylinder and a compression mechanism is operationally connected to the pair of braking elements. The compression mechanism spring biases the pair of braking elements against the brake cylinder and has an actuator configured to resist the spring biasing of the pair of braking elements.

Each of the pair of braking elements preferably has an internal recess that matches an outer shape of the brake cylinder. The actuator of the compression mechanism is preferably an electromagnetic actuator between the pair of braking elements. The electromagnetic actuator is configured to repel the pair of braking elements when activated. Each of the pair of braking elements preferably has an element arm pivotally attached to a base frame of the safety brake system. The compression mechanism interacts with the element arm on each of the pair of braking elements to pivot it against or away from the brake cylinder.

A normal operational state of the safety braking element exists when the compression mechanism is activated to pivot the pair of braking elements away from the brake cylinder. An abnormal operational state of the safety braking element exists when the compression mechanism is deactivated to pivot the pair of braking elements against the brake cylinder.

In another embodiment, the pumping unit may also include a moving mechanism to move the main tower frame from a normal operation position to a workover position. The moving mechanism is mounted at a base of the main tower frame upon a foundation. The moving mechanism has a foundation frame anchored to the foundation. A plurality of roller assemblies are mounted on the base of the main tower frame. A drive assembly mechanically connects the base of the main tower frame to the foundation frame. The base of the main tower rests on the foundation frame and has a first fixed seat structure fixed thereupon. The foundation frame has a second fixed seat structure fixed thereupon. The drive assembly is mechanically connected to both the first and second fixed seat structures and configured to move the seat structures together or apart, thereby moving the main tower frame along the foundation frame.

The main tower frame is in a normal operation position when the first and second fixed seat structures are apart such that the suction rod is proximate to a wellhead borehole. The main tower frame is in a workover position when the first and second fixed seat structures are together such that the suction rod is distant from the wellhead borehole.

The drive assembly preferably comprises a drive screw that is secured to the first fixed seat structure by a stop nut and is threadingly engaged with internal threads on the second fixed seat structure. A drive input in the drive screw is configured to rotate the drive screw relative to the second fixed seat structure. The drive input may be either a hand wheel or a motor.

The roller assemblies are retractably mounted on the base of the main tower frame such that the roller assemblies either rest on the foundation or are raised off of the foundation. The normal operation position of the main tower frame has the roller assemblies retracted and the base of the main tower frame anchored to the foundation. A moving position of the main tower frame—between the normal operation position and the workover position—has the base of the main tower frame unanchored from the foundation and the roller assemblies extended.

This invention of a numerically controlled tower type pumping unit with combination drive includes a main tower frame, a power system, a drive system, a control system, a balance weight box, a balance weight wire rope, a wire rope wheel, a drive wire rope, and a wire rope hanger. The power system, the drive system, the control system, and the wire rope wheel are all placed on an operating platform at a top of the tower frame. The control system is electrically connected to the power system to control the speed and the reversing position of the power system. The power system is mechanically connected to the wire rope wheel via the drive system. The wire rope wheel is mounted on the wire rope wheel shaft. The two ends of the wire rope wheel shaft are placed on the wire rope wheel supports, which wire rope wheel supports are mounted on the top platform. A safety brake system is installed in the drive system. A tower moving system is installed between the concrete foundation and the base frame of the main tower frame.

In a further embodiment of the numerically controlled tower type pumping unit with combination drive, the drive system includes a small pulley, a large pulley, a speed reducer with two or fewer shafts, a safety brake system installed on the speed reducer, a small gear and a large gear. The small pulley is fastened to an output shaft of the power system. The large pulley and the small gear are fastened on ends of the speed reducer shafts. Belts connect the small pulley and the large pulley. A safety brake system cylinder is fastened on one of the two or fewer speed reducer shafts. The cylinder is wrapped around the shaft by two compression braking elements, with each braking element fastened on a separate element mounting arm. Each element mounting arm is mounted by a shaft on a safety brake system base, with the base mounted on the operation platform. The element mounting arms are connected via an electromagnetic spring compression mechanism, which is electrically connected to the control system. The control system provides the power to activate or de-activate the mechanism to permit or to stop rotation of the speed reducer shaft in different operation situations. The safety brake system ensures proper and safe operation of the Drive pumping unit.

In yet a further embodiment of the numerically controlled tower type combination drive pumping unit, the drive system includes a small pulley, a large pulley, a speed reducer with two or fewer shafts, a safety brake system installed on the speed reducer, a small gear and a large gear. The small pulley is fastened to an output shaft of the power system. The large pulley and the small gear are fastened on ends of the speed reducer shafts. Belts connect the small pulley and the large pulley. A tower moving system is placed between the base frame of the main tower frame and the concrete foundation. The tower moving system includes a foundation frame, a drive system, a moving mechanism, and height adjustable rollers. The foundation frame is anchored on the concrete foundation. A first fixed seat structure is mounted on the foundation frame. The first fixed seat structure is disposed one end of the moving mechanism. A second fixed seat structure is disposed on the other end of the moving mechanism. The second fixed seat structure is mounted on a base frame of the main tower frame. The height adjustable rollers are fastened by a nut and bolt to the base frame of the main tower frame. The height adjustable rollers are typically raised off the foundation to permit the main tower frame to sit on the foundation frame during normal operation. The main tower frame is preferably anchored to the concrete foundation during normal operation. The height adjustable rollers may be lowered onto the foundation and any anchoring removed to permit the main tower frame to be moved from the normal operation position at one end of the moving mechanism to a new location at the other end of the moving mechanism.

In an earlier disclosed embodiment, the numerically controlled tower type combination drive pumping unit includes a main tower frame, a power system, a drive system, a control system, a balance weight box, a balance weight wire rope, a wire rope wheel, a drive wire rope, and a wire rope hanger. The power system, the drive system, the control system, and. the wire rope wheel are all placed on an operating platform at a top of the main tower frame. The control system is electrically connected to the power system to control the speed and the reversing position of the power system. The power system is mechanically connected to the wire rope wheel via the drive system. The wire rope wheel is mounted either via taper roller bearings or directly on the wire rope wheel shaft. Two ends of the wire rope wheel shaft are fastened respectively on two split body bearing seats, which bearing seats are installed on the wire rope wheel supports. In the case of taper roller bearings, they are installed on two sides of the wire rope wheel or the wire rope wheel shaft. The wire rope wheel shaft or roller wheels are capable of rolling on a rolling plane of a flat rolling surface of the lengthened wire rope wheel supports.

One position limiting plate may be placed at each end of the rolling plane which also has a locating block to fasten the roller wheels. The locating block preferably has a circular arc contacting surface to match the surface of the roller wheel or the wire rope wheel shaft. The locating block may also be fastened to the rolling plane by dismountable bolts. The roller wheel preferably has an outer pressure cover installed on the outer side of the roller wheel and an inner pressure cover installed on the inner side of the roller wheel through the wire rope wheel shaft.

The drive system preferably includes a small pulley, a large pulley, a speed reducer or a first drive shaft, a small sprocket, and a large sprocket. The small pulley is fastened on an output shaft of the power system. The large pulley and the small sprocket are fastened respectively on an input shaft and an output shaft of the speed reducer. Belts are installed on the small pulley and large pulley. The large sprocket is fastened coaxially on one side of the wire rope wheel. The small sprocket and the large sprocket are dynamically connected by a chain.

Alternatively, the drive system may include a small gear, a large gear, a first drive shaft, a small sprocket and a large sprocket. The small gear is fastened on an output shaft of the power system. The first drive shaft is placed on the operating platform on top of a shaft seat. The large gear and small sprocket are fastened respectively on two ends of the first drive shaft. The large gear is meshed with the small gear. The large sprocket and the wire rope wheel are fastened correspondingly on the wire rope wheel shaft. The small sprocket and the large sprocket are dynamically connected by a chain.

In yet another alternative, the drive system may include a small pulley, a large pulley, a first drive shaft, a small sprocket and a large sprocket. The small pulley is fastened on an output shaft of the power system. The first drive shaft is placed on the operating platform via a shaft seat. The large pulley and small sprocket are fastened respectively on two ends of the first drive shaft. The large pulley and the small pulley are dynamically connected by a belt. The large sprocket and the wire rope wheel are fastened correspondingly on the wire rope wheel shaft. The small sprocket and the large sprocket are dynamically connected by a chain.

The earlier disclosed embodiment of the numerically controlled tower type combination drive pumping unit differentiated from prior technology in that it placed the wire rope wheel shaft or the roller wheel on the rolling plane on top of the wire rope wheel support. This allowed the wire rope wheel shaft or the roller wheels to roll on the rolling plane. The limiting plates and the locating blocks were able to fasten the wire rope wheel shaft or the roller wheels to two ends of the rolling plane. It only required one to unfasten the locating blocks and push the wire rope wheel shaft or the roller wheels to roll to one end of the rolling plane to provide space for well workover. This movement could be manually achieved with operational simplicity, time and labor saving due to the smaller rolling friction resulting in smaller required force to push the roller wheels.

The present improvement on the numerically controlled tower type combination drive pumping unit involves the tower moving system to improve the provision of well workover space. The tower moving system moves the entire tower along fixed seat structure on a foundation frame across the concrete foundation.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

In the following detailed description, previously disclosed embodiments of the numerically controlled tower type combination drive pumping unit are shown in FIGS. 1-5. These embodiments, as described in the following paragraphs, vary in the manner in which the drive system is connected to the wire rope wheel.

Figure 1:
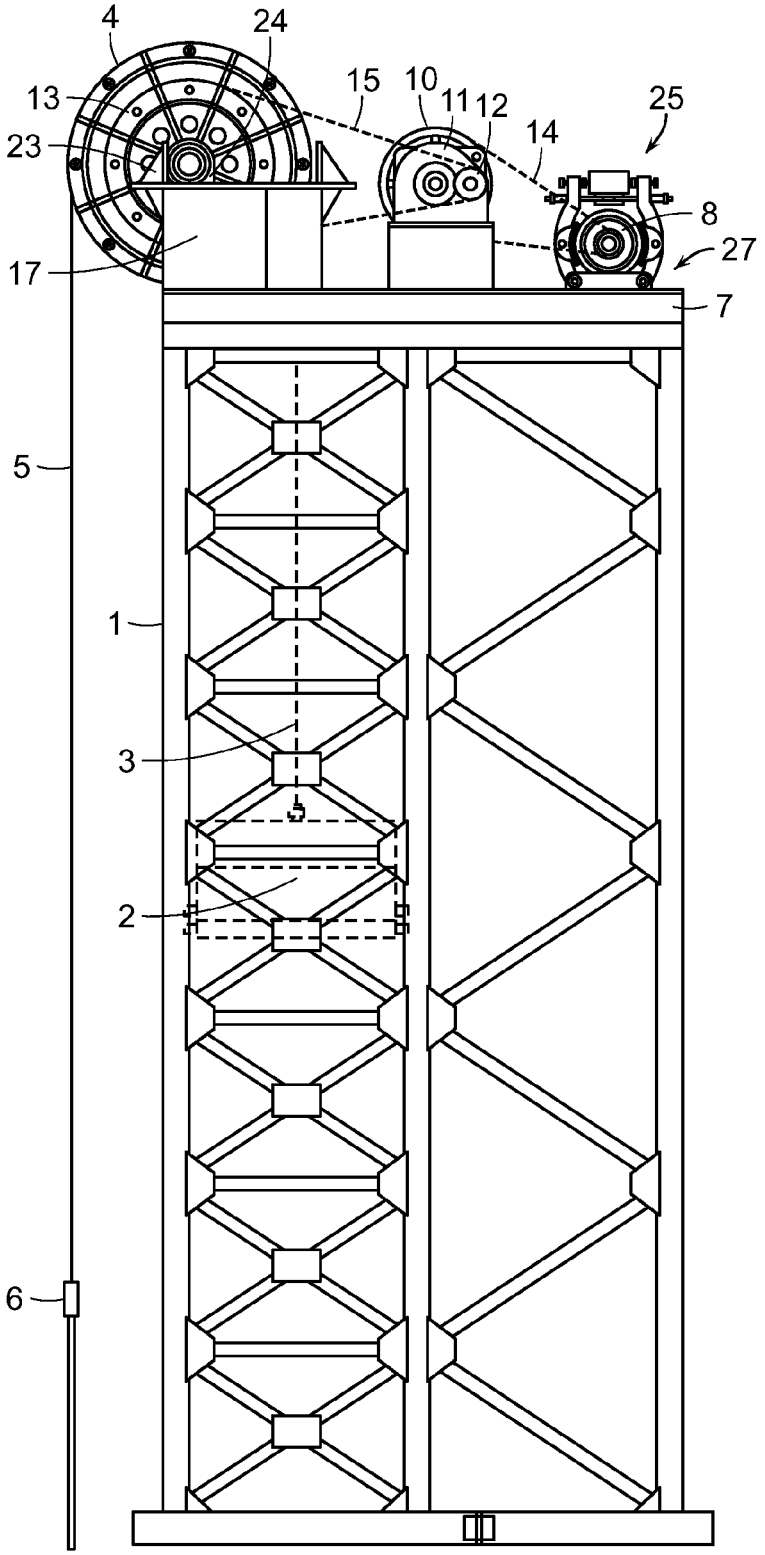
FIG. 1 is a front view of the numerically controlled tower type combination drive pumping unit according to the earlier disclosed embodiment of this invention.
Figure 2:
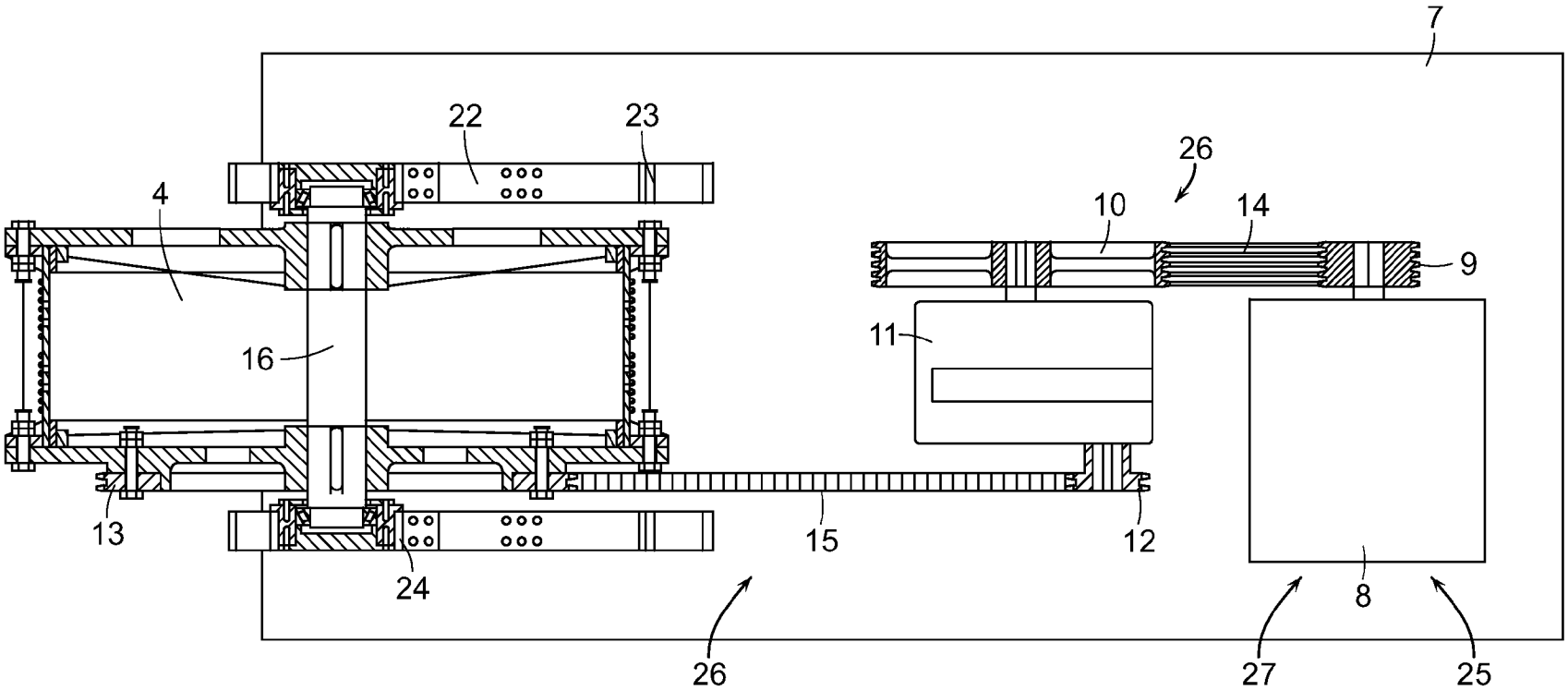
FIG. 2 is a top view of the numerically controlled tower type combination drive pumping unit according to the earlier disclosed embodiment of this invention.

As FIG. 1 and FIG. 2 indicate, the first embodiment of the prior disclosed invention of a numerically controlled tower pumping unit with combination drive includes a main tower frame 1, a power system 25, a drive system 26, a control system 27, a balance weight box 2, a balance weight pull rope 3, a wire rope wheel 4, a drive wire rope 5, and a wire rope hanger 6. The power system 25, the drive system 26, the control system 27, and the wire rope wheel 4 are all installed on an operation platform 7 at the top of the main tower frame 1. The control system 27 is electrically connected to and/or integrated with the power system 25, the power system 25 having a motor 8. The control system 27 controls the reversing position and speed of the motor 8. The motor 8 is dynamically connected to the wire rope wheel 4 by the drive system 26. The drive system 26 includes a small pulley 9, a large pulley 10, a speed reducer 11, a small sprocket 12, a large sprocket 13, and connections between the pulleys and sprockets. The small pulley 9 is fastened to an output shaft of the motor 8. The large pulley 10 and the small sprocket 12 are fastened respectively on input and output shafts of the speed reducer 11. The large sprocket 13 is fastened coaxially to one side of the wire rope wheel 4. A belt 14 is installed on the large pulley 10 and the small pulley 9. The small sprocket 12 and the large sprocket 13 are dynamically connected by a chain 15.

Figure 3:
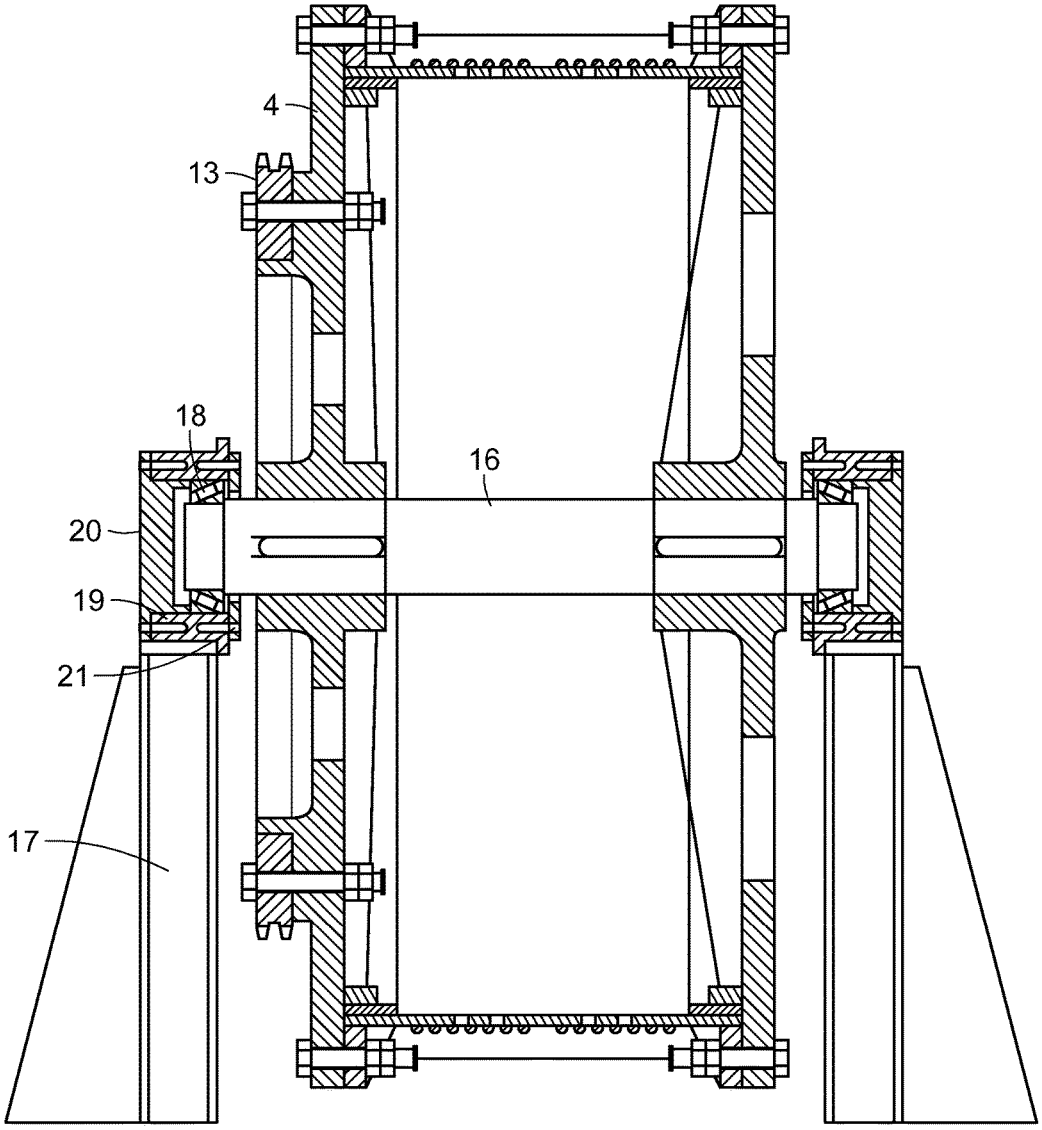
FIG. 3 is a side view of the wire rope wheel of the numerically controlled tower type combination drive pumping unit according to the earlier disclosed embodiment of this invention.

As the FIG. 3 indicates, the wire rope wheel 4 is fastened to the wire rope wheel shaft 16. Two ends of wire rope wheel shaft 16 are installed on the wire rope wheel supports 17 and are installed respectively in two roller wheels 19 via taper roller bearings 18. A roller wheel outer pressure cover 20 is fastened with bolts on the outer side of roller wheel 19. A roller wheel inner pressure cover 21 is fastened with bolts on the inner side of roller wheel 19 encasing the wire rope wheel shaft 16. The two roller wheels 19 are placed on a rolling plane 22 of the wire rope wheel support 17. Limiting plates 23 are set respectively at two ends of the rolling plane 22. There are also locating blocks 24 to fix the roller wheels 19 on the rolling plane 22. The locating blocks 24 possess a circular arc shaped contacting surface in contact with the surface of the roller wheel 19. The locating blocks 24 are fastened on the rolling plane 22 by dismountable bolts.

When the well workover space is needed, the locating blocks 24 are unfastened from the rolling plane 22, and the wire rope wheel 4 is pushed to roll the roller wheels 19 to the rear along the rolling plane 22. The locating blocks 24 are then refastened on the rolling plane 22 when the roller wheels 19 are in contact with the rear limiting plates 24.

Figure 4:
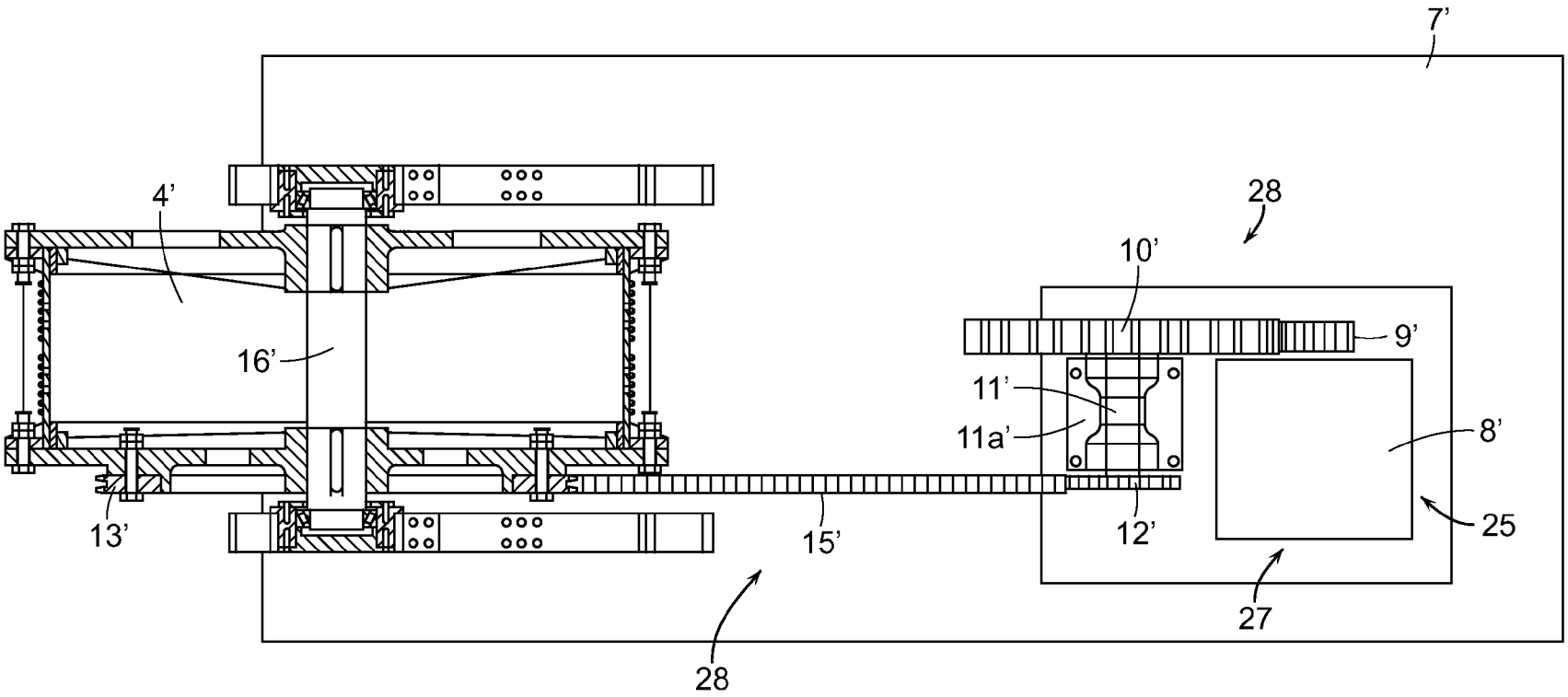
FIG. 4 is a top view of the numerically controlled tower type combination drive pumping unit according to an alternate earlier disclosed embodiment of this invention.

As FIG. 4 indicates, the second embodiment of the prior disclosed invention of a numerically controlled tower pumping unit with combination drive differentiates from the first embodiment in the drive system. In this second embodiment, the drive system 28 includes a small gear 9', a large gear 10', a first drive shaft 11', a small sprocket 12', a large sprocket 13', and connections between the gears and sprockets. The small gear 9' is fastened to an output shaft of the motor 8'. The first drive shaft 11' is installed on the operation platform 7' by a shaft seat 11*a*'. The large gear 10' and the small sprocket 12' are fastened respectively at two ends of the first drive shaft 11'. The large gear 10' is enmeshed with the small gear 9'. The large sprocket 13' and the wire rope wheel 4' are fastened correspondingly on the wire rope wheel shaft 16'. The small sprocket 12' and the large sprocket 13' are dynamically connected by a chain 15'.

Figure 5:
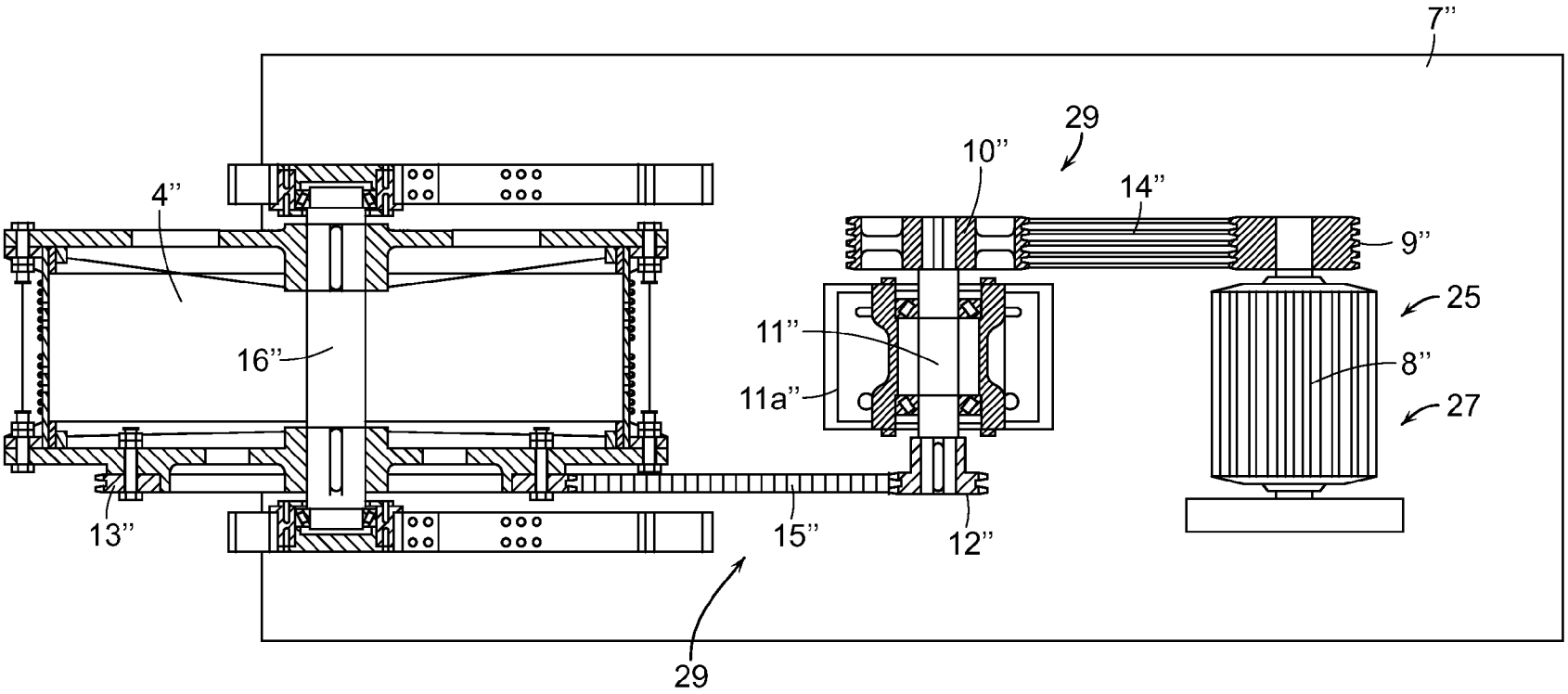
FIG. 5 is a top view of the numerically controlled tower type combination drive pumping unit according to another alternate earlier disclosed embodiment of this invention.
Figure 6:
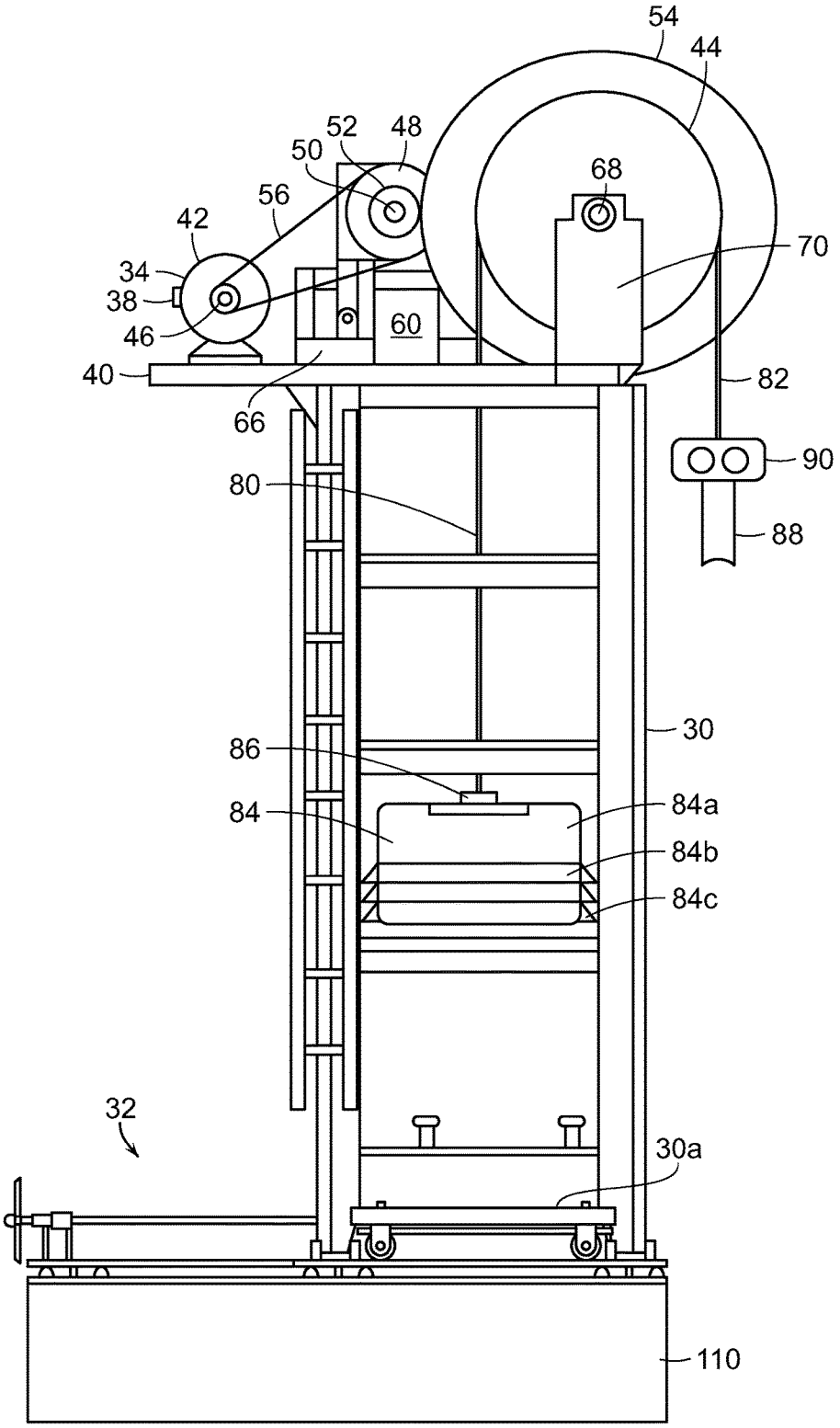
FIG. 6 is a front view of the numerically controlled tower type combination drive pumping unit with tower moving system according to an embodiment of this invention.
Figure 7:
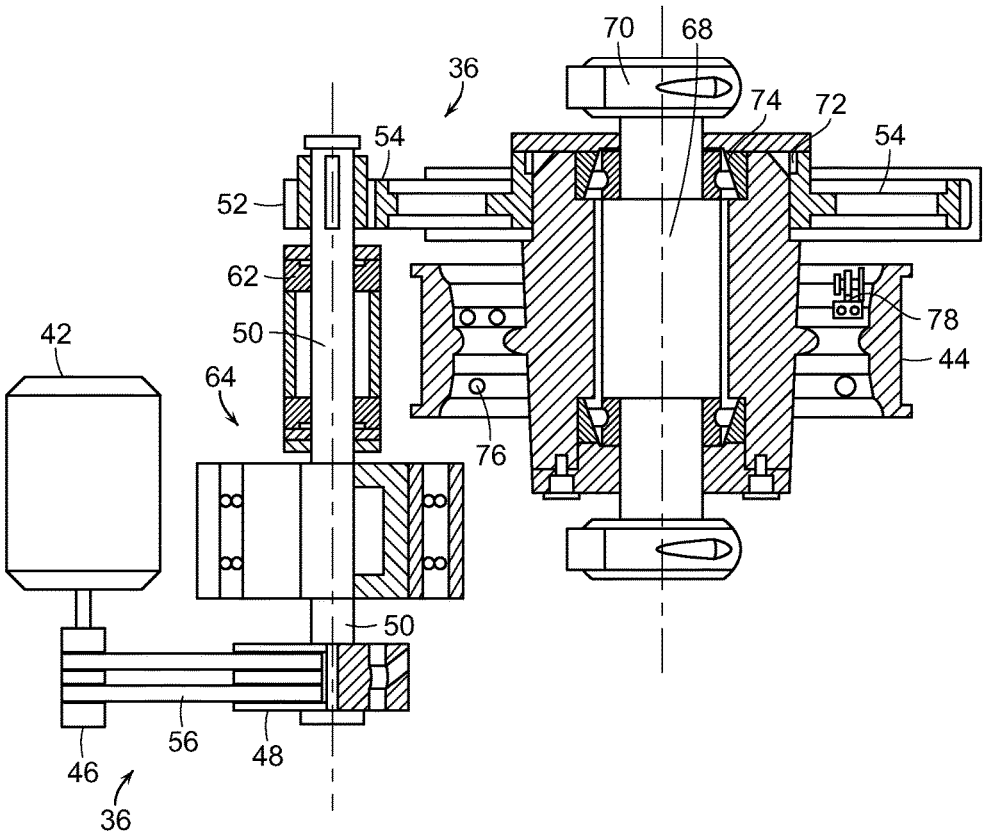
FIG. 7 is a top view of the drive system for the numerically controlled tower type combination drive pumping unit with tower moving system according to an embodiment of this invention.

As FIG. 5 indicates, the third embodiment of the prior disclosed invention of a numerically controlled tower pumping unit with combination drive again differentiates from the first and second embodiments in the drive system. The drive system 29 includes a small pulley 9", a large pulley 10", a first drive shaft 11", a small sprocket 12", a large sprocket 13", and connections between the pulleys and sprockets. The small pulley 9" is fastened to an output shaft of the motor 8". The first drive shaft 11" is installed on the operation platform 7" by a shaft seat 11*a*". The large pulley 10" and the small sprocket 12" are fastened respectively at two ends of the first drive shaft 11". The large pulley 10" and the small pulley 9" are dynamically connected by a belt 14". The large sprocket 13" and the wire rope wheel 4" are fastened correspondingly on the wire rope wheel shaft 16". The small sprocket 12" and the large sprocket 13" are dynamically connected by a chain 15".

FIGS. 6 through 13 illustrate an alternate embodiment of a numerically controlled tower pumping unit that includes a tower moving system. In this alternate embodiment, the main tower frame 30 includes a tower moving system 32. The tower moving system 32 is designed to facilitate movement of the tower unit 30 from a normal operating position near to a wellhead into a new position away from the wellhead. The tower unit 30 is laterally shifted to one side to clear the wellhead for well workover.

The pumping unit is constructed similarly to one of the various embodiments described above and includes similar components. The pumping unit includes a tower frame 30, a power system 34, a drive system 36, and a control system 38, all mounted on an operational platform 40 at the top of the tower frame 30. The power system 34 includes a motor 42, which is preferably a permanent magnet synchronous braking motor. The control system 38 is electrically connected to and/or integrated with the power system 34, and is configured to control the reversing position and speed of the motor 42. The motor 42 is dynamically connected to a wire rope wheel 44 by the drive system 36. The drive system 36 includes a small pulley 46, a large pulley 48, a reducer shaft 50 or similar drive shaft, a small gear 52, a large gear 54, and connections between the pulleys and gears. The small pulley 46 is fastened to an output shaft of the motor 42. The large pulley 48 and the small gear 52 are fastened respectively on opposite ends of the reducer shaft 50. The large gear 54 is fastened coaxially to one side of the wire rope wheel 44. One or more belts 56 connect the large pulley 48 and the small pulley 46 so that the motor turns the drive shaft. The small gear 52 and the large gear 54 are enmeshed so that the turning of the reducer shaft 50 will turn the wire rope wheel 42.

The drive shaft 50 is preferably mounted on a shaft holder 60 with bearings 62. The drive shaft 50 may also include a safety brake system 64 that is mounted on a base 66. The safety brake system surrounds the reducer shaft 50 and provides braking functionality as described more fully below in connection with FIGS. 8 and 9.

The wire rope wheel 42 is fixedly mounted on a rope wheel shaft 68 mounted on wheel supports 70 extending up from the operation platform 40. A dowel 72 on the wheel shaft 68 accepts the large gear 54 through a fixed connection. A second pair of bearings 74 allow for rotation of the rope wheel shaft 68 relative to the wheel supports 70. The wire rope wheel 42 has a plurality of fixing holes 76 and 78. One end of a weight cable 80 is fixed in the first group of fixing holes 76. An end of a driving rope 82 is fixed in the second group of fixing holes 78. The weight cable 80 and driving rope 82 wind around the wire rope wheel 44 in a reverse manner. A free end of the weight cable 80 is connected to a balancing weight box 84 by a cable hanger 86. The free end of the weight cable 80 and the weight box 84 are located at a longitudinal center of the main tower frame 30. A free end of the driving rope 82 is connected to a suction rod 88 by a rope hanger 90, which suction rod 88 is intended to interact with a wellhead or borehole 89.

The weight box 84 may include a major weight box 84*a*, along with a plurality of clamping weight blocks 84*b* of various weights. The plurality of clamping weight blocks 84*b* may be secured to the major box 84*a* by multiple clamps 84*c* on the sides of the weight blocks 84*b*. According to an actual loading of the suction rod 88, the weight of the major weight box 84*a* can be adjusted with selected clamping weight blocks 84*b* so as to achieve a relatively balanced working state with the suction rod 88. This balanced working state may assist in reducing energy consumption of the power system 34 and the drive system 36.

Figure 8:
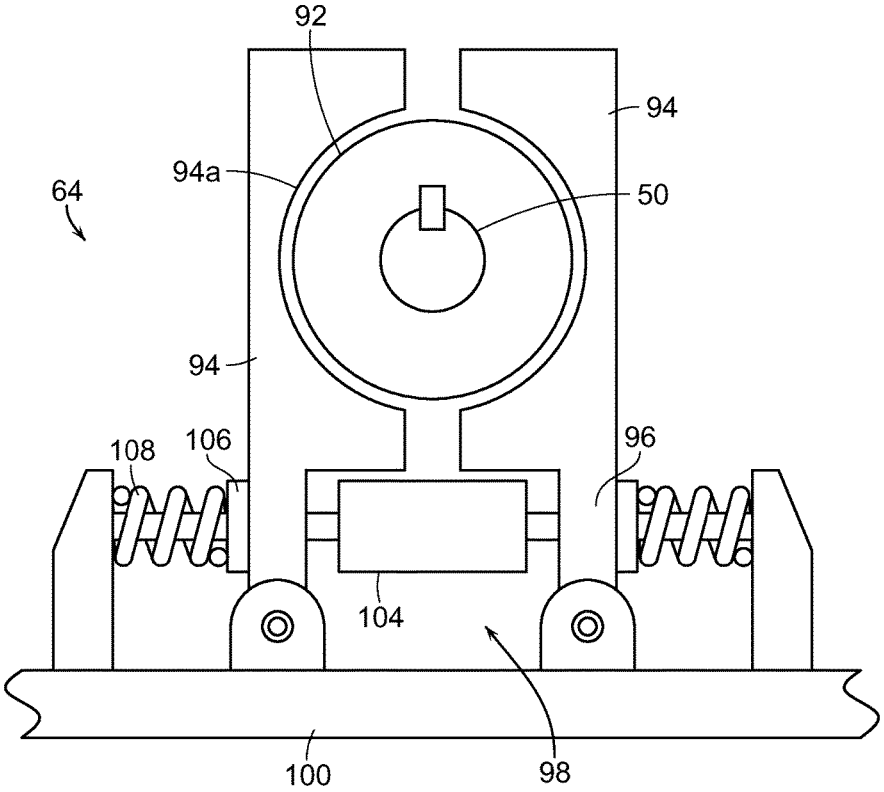
FIG. 8 is a sectional view of the safety brake system for the numerically controlled tower type combination drive pumping unit with tower moving system according to an embodiment of this invention.
Figure 9:
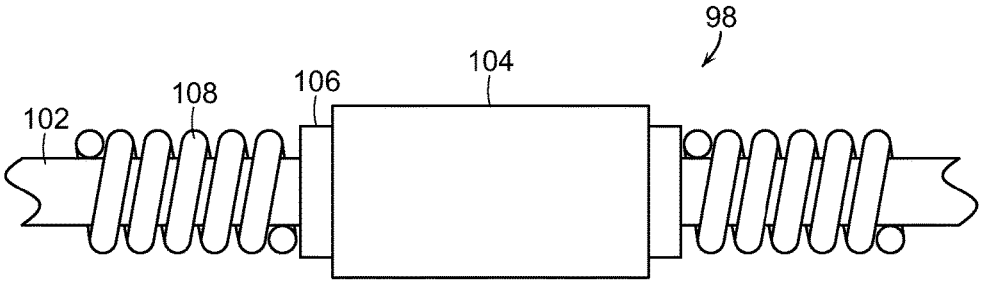
FIG. 9 is a detailed view of the electromagnetic spring compression mechanism of the safety brake system according to an embodiment of this invention.
Figure 10:
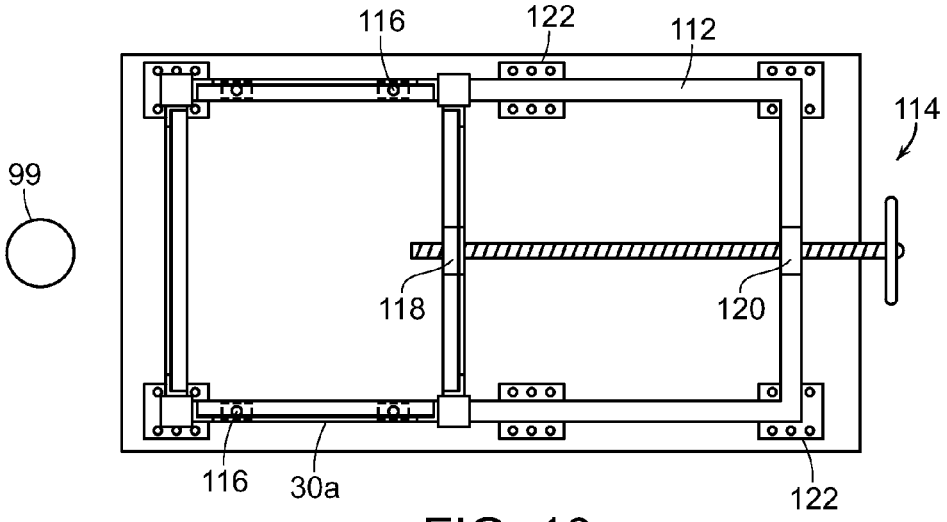
FIG. 10 is a top view of the tower moving system for use with the numerically controlled tower type combination drive pumping unit according to an embodiment of this invention.
Figure 11:
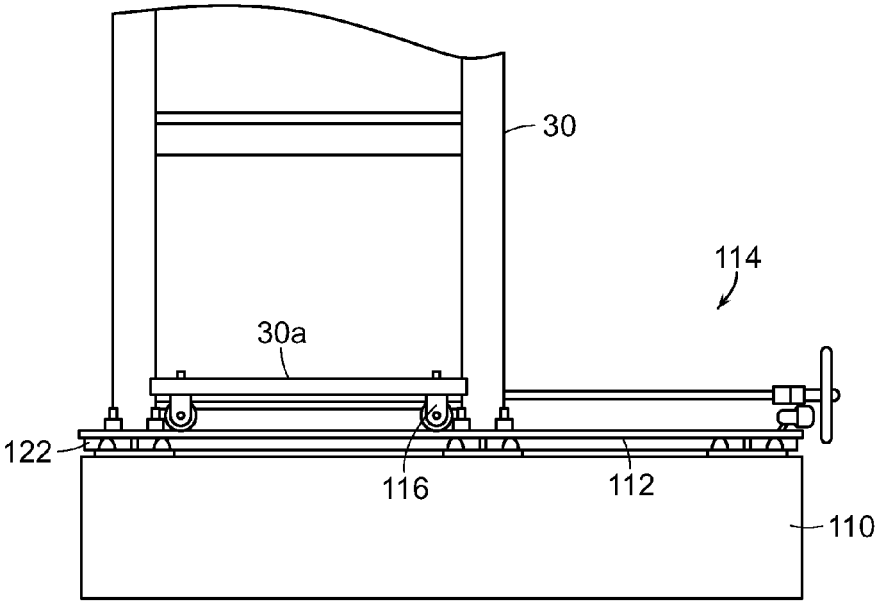
FIG. 11 is a partial front view of the numerically controlled tower type combination drive pumping unit with tower moving system according to an embodiment of this invention.

FIGS. 8 and 9 illustrate the safety braking system 64 and the components thereof. The safety braking system 64 includes a brake cylinder 92, and a set of braking elements 94 that surround the cylinder 92, with each braking element 94 having a set of element arms 96. Each braking element 94 has an internal recess 94*a* configured to closely match the outer shape of the brake cylinder 92 to provide more contact surface and allow for greater braking power. A compression mechanism 98 passes through the set of element arms 96. The compression mechanism 98 is preferably an electromagnetic spring compression device, which may be triggered by the control system 38. All of these elements are mounted on a base frame 100, which may be mounted upon or integral with the brake system base 66 described above. The reducer shaft 50 passes through the brake cylinder 92 such that the braking elements 94 may compress or clamp down on the brake cylinder 92 to impede or stop rotation of the reducer shaft 50.

The compression mechanism 98 comprises an elongated shaft 102, an electromagnetic actuator 104, pressure rings 106 disposed at each end of the actuator 104 and coaxially with the shaft 102, and springs 108 disposed on each end of the mechanism 98 abutting against the pressure rings 106. When the mechanism 98 passes through the element arms 96, each arm is preferably disposed the actuator 104 and one of the pressure rings 106. The element arms 96 are preferably pivotally connected to the base frame 100. The point of connection between the base frame 100 and the elements arms 96 is preferably in-line with or slightly outside the maximum diameter of the brake cylinder 92.

In operation, the control system 38 provides power to the electromagnetic actuator 104 of the compression mechanism 98. This repels the braking elements 94, which pivot outwards due to the fixing of the elements arm 96 to the base frame 100. With the braking elements 94 repelled, the brake cylinder 92 and reducer shaft 50 are permitted to rotate freely during normal operating conditions. In abnormal operating conditions, such as belt or wire breakage, electric overload, mechanical overload, environmental overload, or other abnormal conditions, the control system 38 cuts power to the electromagnetic actuator 104. Without the electromagnetic force of the actuator 104 to repel the braking elements 94, the springs 108 force the braking elements 94 inward against the brake cylinder 92 so as to stop rotation of the reducer shaft 50. This would prevent a sudden drop of the weight box 84, a drop of the cable hanger 86, or other catastrophic failure due to one of the abnormal conditions described above.

FIGS. 10, 11, 12A, 12B, and 13 generally show the tower moving system 32 and its components, which are disposed at the base of the main tower frame 30. A concrete foundation 110 or similarly durable surface that may be found around or adjacent to a wellhead or borehole 89 is preferably provided to have a flat surface. The tower moving system 32 generally includes a foundation frame 112, a moving mechanism 114, and height adjustable roller assemblies 116. The main tower 30 includes a base frame 30*a* to which the roller assemblies 116 are attached as by a tube nut through a raiser block welded on the base frame 30*a*.

A first fixed seat structure 118 is fastened to the base frame 30*a*. The first fixed seat structure 118 is connected to one end of the moving mechanism 114. The other end of the moving mechanism 114 is connected to a second fixed seat structure 120 that is itself fastened to the foundation frame 112. The foundation frame 112 is preferably constructed using structural steel pipes in a generally rectangular configuration that is anchored to the foundation 110 by a plurality of fasteners 122.

Figure 12A:
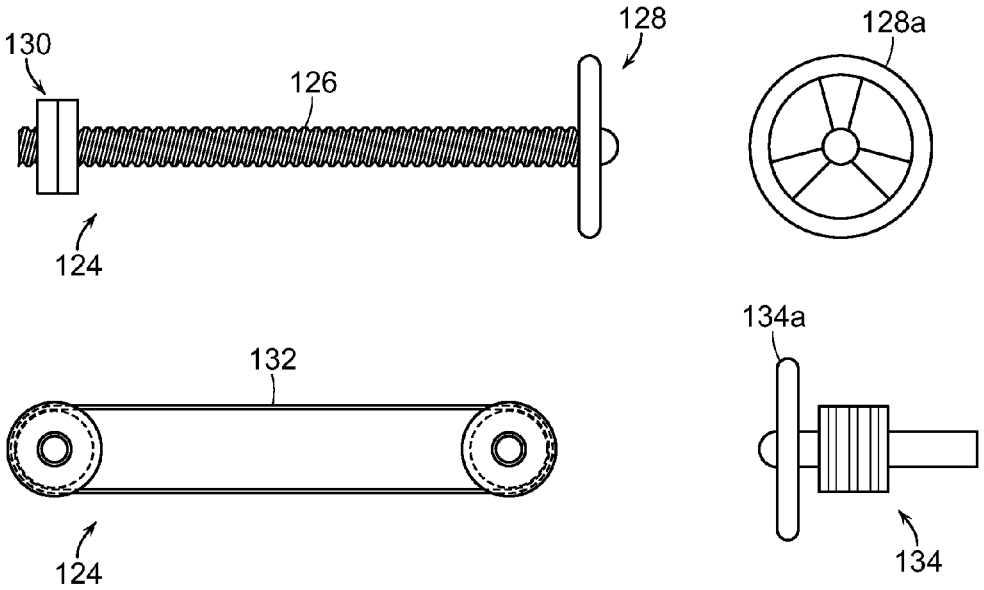
FIG. 12A is a detailed view of the parts of the drive assembly for the tower moving system according to an embodiment of this invention.
Figure 12B:
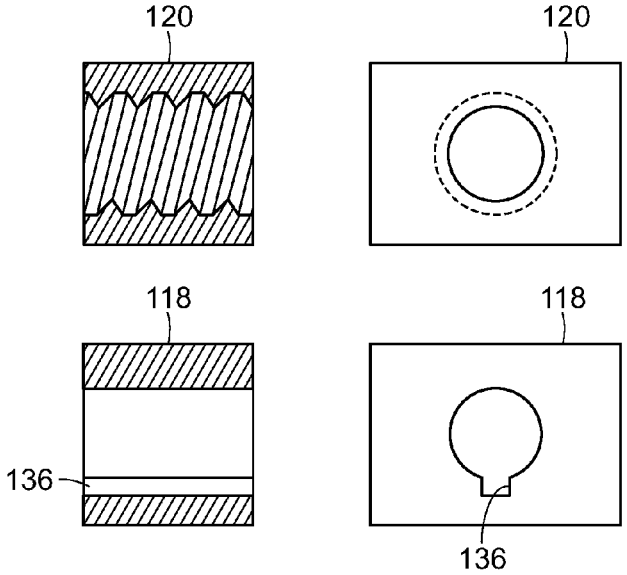
FIG. 12B is a detailed view of the parts of the fixed seat structure for the tower moving system according to an embodiment of this invention.
Figure 13:
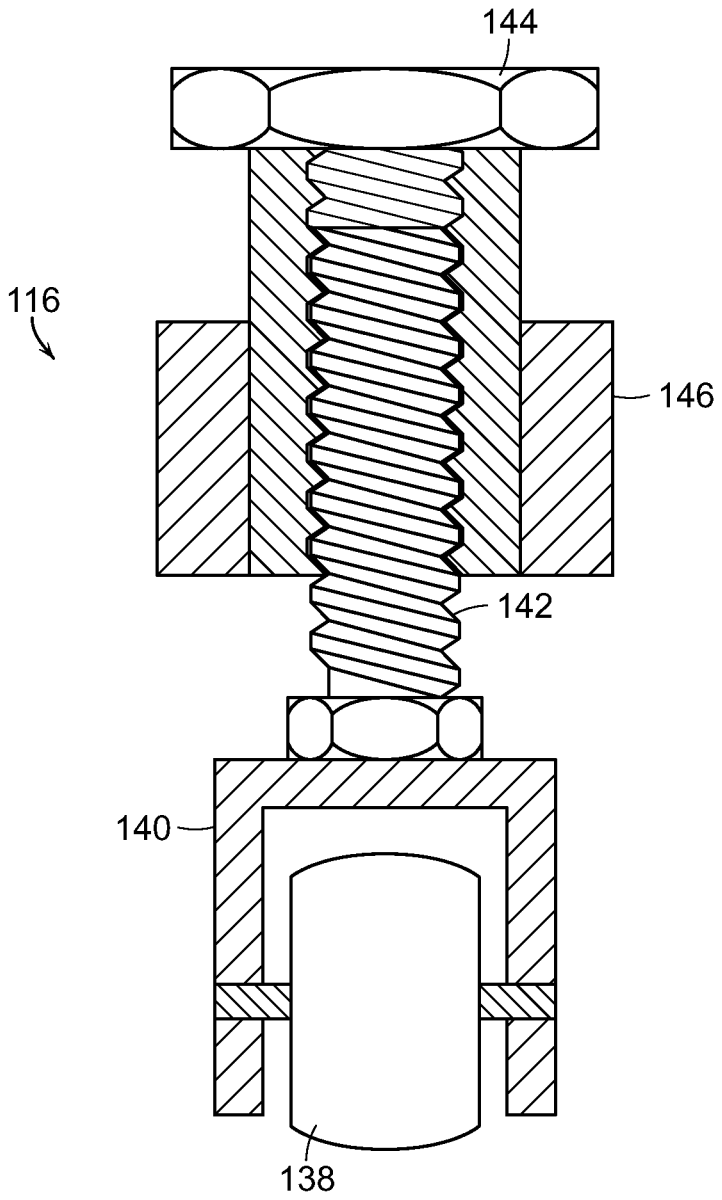
FIG. 13 is a detailed view of the height adjustable roller for the tower moving system according to an embodiment of this invention.

The moving mechanism 114 includes a drive assembly 124 which may come in several forms. The drive assembly 124 may include a threaded drive screw 126 with a drive input 128 at one end and a stop nut 130 at the other end. The drive input 128 may include a hand wheel 128*a* or a powered input as from a motor (not shown). In this configuration, the drive screw 126 may be passed through the fixed seat structures 118, 120 (FIG. 12B). FIG. 12B shows the cross-section of bores through the seat structures 118, 120. The bore through the first fixed seat structure 118 is generally circular with a keyed hole 136. The bore through the second fixed seat structure 120 is generally threaded. As the drive screw 126 is turned, the first fixed seat structure 118 is drawn toward or pushed away from the second fixed seat structure 120. In this way, the position of the base frame 30*a* relative to the foundation frame 112 can be adjusted. Alternatively, the drive assembly 124 may include a drive belt, wire rope, or cable 132 that spans from the first fixed seat structure 118 to the second fixed seat structure 120. A drive input 134—again being either a hand wheel 134*a* or a powered input—is disposed proximate to the second fixed seat structure 120. When activated, the drive input 134 turns the belt, wire, rope, or cable 132 such that the first fixed seat structure 118 is drawn toward or pushed away from the second fixed seat structure 120.

The height adjustable roller assemblies 116 include a roller 138, a height adjustable bracket 140, a fixed bolt 142, a tube nut 144, and a raiser block 146. The bolt 142 is fixed, preferably welded or similar permanent attachment, to the bracket 140. The raiser block 146 is fixed, preferably welded or similar permanent attachment, to the base frame 30*a*. In normal operating position, the roller assemblies 116 are raised above the foundation frame 112. In addition, the tower unit 30 is preferably anchored to the foundation 110 to prevent accidental movement. To move the tower unit 30 into a well workover position, the anchors are removed and the roller assemblies 116 are lowered so at to contact the foundation 110. The lowered roller assemblies 116 raise the tower unit 30 a sufficient distance above the foundation 110 so as the permit movement of the tower unit into the well workover position. The tower unit 30 can be moved by engaging the moving mechanism 114. After the tower unit 30 is moved into the well workover position, the roller assemblies 116 may be raised again and the fasteners 122 replaced to again prevent accidental movement during workover. After any workover is completed, the tower unit 30 can be moved back into an operating position by reversing the above steps.

The Numerical Controlled Tower Type Combination Drive Pumping Unit has strong industrial utility by improving the safety of the drive and control systems, the mobility of the tower pumping unit, and by reducing the labor intensity required during oil well workover operations.

Although several embodiments have been described in detail for purposes of illustration, various modifications may be made without departing from the scope and spirit of the invention. Accordingly, the invention is not to be limited, except as by the appended claims.

What is claimed is:

1. A tower drive pumping unit, comprising:

a main tower frame supporting a raised operating platform, with a power system, a drive system, and a control system mounted thereon, wherein the power system is electrically connected to the drive system to power the drive system, the control system is operationally connected to the drive system, and the drive system is configured to operate a wire rope wheel that alternately raises and lowers a suction rod and a balanced weight box; and a moving mechanism mounted at a base of the main tower frame upon a foundation, the moving mechanism comprising a foundation frame anchored to the foundation, a plurality of roller assemblies mounted on the base of the main tower frame, and a drive assembly, wherein the base of the main tower frame rests on the foundation frame and has a first fixed seat structure fixed thereupon, wherein the foundation frame has a second fixed seat structure fixed thereupon, and wherein the drive assembly is connected to both the first and the second fixed seat structures and configured to move the seat structures together or apart, thereby moving the main tower frame along the foundation frame.

2. The pumping unit of claim 1, wherein the main tower frame is in a normal operation position when the first and second fixed seat structures are apart such that the suction rod is proximate to a wellhead borehole.

3. The pumping unit of claim 2, wherein the main tower frame is in a workover position when the first and second fixed seat structures are together such that the suction rod is distant from the wellhead borehole.

4. The pumping unit of claim 1, wherein the drive assembly comprises a drive screw that is secured to the first fixed seat structure by a stop nut and is threadingly engaged with internal threads on the second fixed seat structure, and has a drive input configured to rotate the drive screw relative to the second fixed seat structure.

5. The pumping unit of claim 4, wherein the drive input comprises either a hand wheel or a motor.

6. The pumping unit of claim 1, wherein the roller assemblies are retractably mounted on the base of the main tower frame such that the roller assemblies either rest on the foundation or are raised off of the foundation.

7. The pumping unit of claim 6, wherein a normal operation position of the main tower frame has the roller assemblies retracted and the base of the main tower frame anchored to the foundation.

8. The pumping unit of claim 7, wherein a moving position of the main tower frame has the base of the main tower frame unanchored from the foundation and the roller assemblies extended.

9. A tower drive pumping unit, comprising:

a main tower frame supporting a raised operating platform, with a power system, a drive system, and a control system mounted thereon, wherein the power system is electrically connected to the drive system to power the drive system, the control system is operationally connected to the drive system, and the drive system is configured to operate a wire rope wheel that alternately raises and lowers a suction rod and a balanced weight box;

a safety brake system operationally connected to the drive system, wherein the safety brake system has a brake cylinder fixedly disposed around a rotating shaft of the drive system, a pair of braking elements surrounding the brake cylinder, and a compression mechanism operationally connected to the pair of braking elements, wherein the compression mechanism spring biases the pair of braking elements against the brake cylinder and has an actuator configured to resist the spring biasing of the pair of braking elements; and a moving mechanism mounted at a base of the main tower frame upon a foundation, the moving mechanism comprising a foundation frame anchored to the foundation, a plurality of roller assemblies mounted on the base of the main tower frame, and a drive assembly, wherein the base of the main tower frame rests on the foundation frame and has a first fixed seat structure fixed thereupon, wherein the foundation frame has a second fixed seat structure fixed thereupon, and wherein the drive assembly is connected to both the first and the second fixed seat structures and configured to move the seat structures together or apart, thereby moving the main tower frame along the foundation frame.

10. The pumping unit of claim 9, wherein each of the pair of braking elements has an internal recess that matches an outer shape of the brake cylinder.

11. The pumping unit of claim 9, wherein the actuator of the compression mechanism is an electromagnetic actuator between the pair of braking elements, the electromagnetic actuator configured to repel the pair of braking elements when activated.

12. The pumping unit of claim 9, wherein each of the pair of braking elements has an element arm pivotally attached to a base frame of the safety brake system and the compression mechanism interacts with the element arm on each of the pair of braking elements to pivot it against or away from the brake cylinder.

13. The pumping unit of claim 12, wherein a normal operational state of the safety brake system exists when the compression mechanism is activated to pivot the pair of braking elements away from the brake cylinder.

14. The pumping unit of claim 12, wherein an abnormal operational state of the safety brake system exists when the compression mechanism is deactivated to pivot the pair of braking elements against the brake cylinder.

15. The pumping unit of claim 9, wherein the main tower frame is in a normal operation position when the first and second fixed seat structures are apart such that the suction rod is proximate to a wellhead borehole.

16. The pumping unit of claim 15, wherein the main tower frame is in a workover position when the first and second fixed seat structures are together such that the suction rod is separated from the wellhead borehole.

17. The pumping unit of claim 9, wherein the drive assembly comprises a drive screw that is secured to the first fixed seat structure secured by a stop nut and is threadingly engaged with internal threads on the second fixed seat structure, and has a drive input configured to rotate the drive screw relative to the second fixed seat structure.

18. The pumping unit of claim 17, wherein the drive input comprises either a hand wheel or a motor.

19. The pumping unit of claim 9, wherein the roller assemblies are retractably mounted on the base of the main tower frame such that the rollers assemblies either rest on the foundation or are raised off of the foundation.

20. The pumping unit of claim 19, wherein a normal operation position of the main tower frame has the roller assemblies retracted and the base of the main tower frame anchored to the foundation.

21. The pumping unit of claim 20, wherein a moving position of the main tower frame has the base of the main tower frame unanchored from the foundation and the roller assemblies extended.

* * * * *